US011882931B1

(12) United States Patent
Arnall

(10) Patent No.: US 11,882,931 B1
(45) Date of Patent: Jan. 30, 2024

(54) EXPANDABLE SHELF ASSEMBLY

(71) Applicant: Randall E. Arnall, Springfield, MO (US)

(72) Inventor: Randall E. Arnall, Springfield, MO (US)

( * ) Notice: Subject to any disclaimer, the term of this patent is extended or adjusted under 35 U.S.C. 154(b) by 0 days.

(21) Appl. No.: 17/513,157

(22) Filed: Oct. 28, 2021

Related U.S. Application Data

(60) Provisional application No. 63/106,542, filed on Oct. 28, 2020.

(51) Int. Cl.

| | |
|---|---|
| ***A47B 45/00*** | (2006.01) |
| ***A47B 96/02*** | (2006.01) |
| *A47B 31/00* | (2006.01) |
| *A47B 47/00* | (2006.01) |

(52) U.S. Cl.
CPC ..... *A47B 45/00* (2013.01); *A47B 96/025* (2013.01); *A47B 31/00* (2013.01); *A47B 47/0083* (2013.01); *A47B 47/0091* (2013.01)

(58) Field of Classification Search
CPC ... A47B 45/00; A47B 96/025; A47B 47/0091; A47B 47/047; A47B 31/00; A47B 47/00; A47B 47/0083; A47B 47/02; A47B 47/021; A47B 47/027
See application file for complete search history.

(56) References Cited

U.S. PATENT DOCUMENTS 2,918,176 A * 12/1959 Bell ..... A47B 47/027 211/187
3,341,027 A * 9/1967 Mackin, Jr. ..... A47B 57/20 108/106
3,405,665 A * 10/1968 Slonim ..... B65D 19/12 294/67.1
3,465,898 A * 9/1969 Klein ..... A47B 87/0215 211/188
3,647,080 A * 3/1972 Denny ..... A47B 47/027 108/901
3,812,974 A * 5/1974 Sylvester ..... A47F 7/04 211/23
3,912,087 A * 10/1975 Zeischegg ..... A47B 87/007 403/171
4,703,702 A * 11/1987 Speicher ..... B65D 19/385 108/52.1
4,958,841 A * 9/1990 Keen ..... A47F 5/13 280/47.35

(Continued)

*Primary Examiner* — Devin K Barnett
(74) *Attorney, Agent, or Firm* — Jonathan A. Bay

(57) ABSTRACT

A modular unit of a shelf assembly has four vertical corner posts, three pairs of longitudinal shelf-supporting cross beams fastened to the corner posts at respectively spaced elevations, and one shelf member supported by each pair of beams. Whereby this forms a first embodiment of a modular shelf assembly. Lateral modular expansion of the first embodiment into a second embodiment is accomplished by combining of a pair of such first embodiments side-by-side to each other. Depth-wise expansion of the second embodiment into a third embodiment is accomplished by combining of a pair of such second embodiments in a front to back file relative to each other. Stacking-wise expansion of the third embodiment into a fourth embodiment is accomplished by stacking a pair of such third embodiments on top of another, and so on.

11 Claims, 21 Drawing Sheets

(56) References Cited

U.S. PATENT DOCUMENTS 5,233,931 A * 8/1993 McCorkle, Jr. ..... B65D 19/12 108/55.1
5,285,907 A * 2/1994 Franchere ..... F16M 13/00 211/74
D363,841 S * 11/1995 Nourse ..... D6/675.1
D398,787 S * 9/1998 Malik ..... D6/682
D413,702 S * 9/1999 Essary ..... D34/38
6,173,847 B1 * 1/2001 Zellner, III ..... A47B 55/02 211/186
6,202,867 B1 * 3/2001 Di Blasi ..... A47B 87/008 108/138
6,241,108 B1 * 6/2001 Nakatani ..... A47B 87/0207 211/187
6,286,792 B1 * 9/2001 Best ..... B65D 19/44 217/43 A
6,378,712 B1 * 4/2002 Sampl ..... A47B 47/04 211/186
6,402,167 B1 * 6/2002 Calleja ..... B65D 19/44 280/47.35
6,602,032 B2 * 8/2003 Arai ..... B65D 19/385 108/55.3
6,604,640 B1 * 8/2003 Jehin ..... A47B 47/028 52/167.3
D543,057 S * 5/2007 Grady ..... D6/675.1
7,491,024 B2 * 2/2009 Heinrichs ..... B65D 19/12 410/32
8,016,140 B2 * 9/2011 Hsieh ..... A47B 47/0083 211/187
8,210,312 B1 * 7/2012 Tetreault, Jr. ..... E04G 1/34 182/119
9,027,767 B2 * 5/2015 Buckley ..... A47B 57/34 211/134
9,215,926 B1 * 12/2015 Offerman ..... A47B 47/02
9,422,085 B2 * 8/2016 Kemmer, Jr. ..... B65D 19/0095
9,688,462 B2 * 6/2017 Rivera ..... F25D 25/00
9,717,330 B2 * 8/2017 Reinhart ..... A47B 87/0223
10,292,491 B1 * 5/2019 Ke ..... A47F 5/137
D863,843 S * 10/2019 Li ..... D6/675.1
10,538,261 B2 * 1/2020 Nowe ..... B62B 3/005
D878,116 S * 3/2020 Davis ..... D6/675.1
D886,496 S * 6/2020 Davis ..... D6/675.3
10,710,801 B1 * 7/2020 Iellimo ..... B65G 1/06
10,729,236 B2 * 8/2020 Martin, Jr. ..... B62B 3/025
10,806,257 B1 * 10/2020 Liu ..... A47B 47/024
10,835,058 B2 * 11/2020 Sale ..... A47B 57/00
10,934,053 B1 * 3/2021 Payson ..... B65D 19/0012
D915,801 S * 4/2021 Davis ..... D6/675.1
D929,160 S * 8/2021 Groves ..... D6/675.1
2004/0237853 A1 * 12/2004 Sholz ..... A47B 57/40 108/107
2005/0087505 A1 * 4/2005 Lukas ..... G11B 33/0461 211/41.12
2005/0194338 A1 * 9/2005 Firth ..... A47B 87/0253 211/194
2006/0163185 A1 * 7/2006 Konstant ..... A47F 5/01 211/189
2008/0236510 A1 * 10/2008 Silverman ..... A01K 31/08 206/509
2009/0152225 A1 * 6/2009 Lee ..... A47B 47/024 108/106
2009/0184076 A1 * 7/2009 Lee ..... A47B 57/54 211/189
2009/0277854 A1 * 11/2009 Eustace ..... A47B 57/22 211/183
2011/0036798 A1 * 2/2011 Chen ..... A47B 47/0008 211/188
2011/0233164 A1 * 9/2011 Chang ..... A47B 87/001 211/188
2011/0290750 A1 * 12/2011 Lim ..... A47B 47/00 211/153
2014/0353271 A1 * 12/2014 Kruse ..... A47F 5/01 211/188
2015/0083683 A1 * 3/2015 Vazquez ..... A47B 96/1408 211/183
2015/0090683 A1 * 4/2015 Sabounjian ..... A47B 96/14 211/186
2016/0095430 A1 * 4/2016 Moyer ..... A47B 47/0091 211/188
2016/0286956 A1 * 10/2016 Guizzardi ..... A47B 91/026
2016/0331135 A1 * 11/2016 Knudson ..... A47B 87/0215
2017/0086579 A1 * 3/2017 Kam ..... A47B 57/44
2017/0349371 A1 * 12/2017 Valtanen ..... B63B 21/50
2020/0270073 A1 * 8/2020 Wendel ..... B65G 49/062
2022/0133034 A1 * 5/2022 Moyer ..... A47B 87/0284 312/108

* cited by examiner

EXPANDABLE SHELF ASSEMBLY

CROSS-REFERENCE TO PROVISIONAL APPLICATION(S)

This application claims the benefit of U.S. Provisional Application No. 63/106,542, filed Oct. 28, 2020. The foregoing patent disclosure(s) is(are) fully incorporated herein by this reference thereto.

BACKGROUND AND SUMMARY OF THE INVENTION

The invention relates to shelving and, more particularly, to an expandible shelf assembly in which unit modules can be assembled/arranged to expand in all directions, e.g., laterally, depth-wise, stacking and so on (or alternatively, in any of the left-right, in-out, and/or up-down directions).

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings, FIG. 1 is a perspective view of a unit module in accordance with the invention representing a first embodiment of a shelf assembly in accordance with the invention, and serving the purpose of forming various further embodiments of modular shelf assemblies in accordance with the invention by combining in various manners of combinations such as side-by-side combinations, front-to-back file combinations, stacks of one layer upon another combinations and so on;

DETAILED DESCRIPTION OF THE PREFERRED EMBODIMENTS

FIGS. 1-5 and 14-18 show a unit module 100 in accordance with the invention representing a first embodiment of a shelf assembly 100 in accordance with the invention, and serving the purpose of forming various further embodiments of modular shelf assemblies in accordance with the invention (e.g., 100×2W, 100×2W×2D, 100×2w×2D×2H for example and without limitation) formed by combining in various manners of combinations such as side-by-side combinations, front-to-back side combinations, stacks of one layer upon another combinations and so on.

Figure 12:
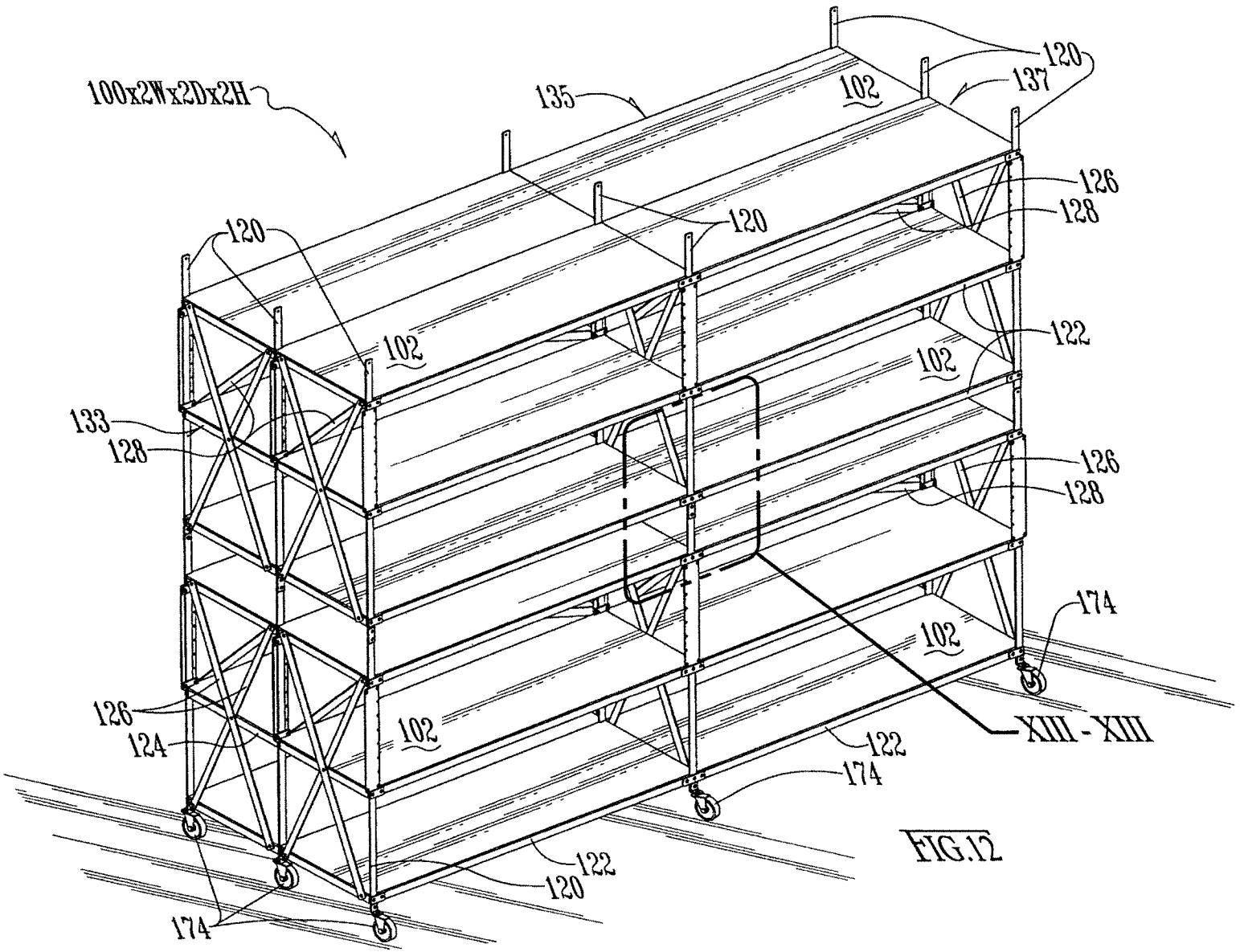
FIG. 12 is a perspective view comparable to FIG. 13 except showing the stacking-wise modular expansion of the third embodiment modular shelf assembly shown by FIG. 11 into a fourth embodiment of a modular shelf assembly in accordance with the invention, as accomplished by stacking a pair of such third embodiment modular shelf assemblies one on top of the other (e.g., a modular shelf assembly which is not only two units wide and two units deep but also two units high)

Preferably the unit module 100, excluding the planar shelf panels/shelf webs 102, is a fixed-beam framework of some suitable structural material such as and without limitation mild steel flat bars. The fixed-beam framework defines an integer number of main shelf elevations 104 (e.g., 104A, 104B, 104C for example and without limitation). FIGS. 1-5 and 14-18 show that the preferred number of main shelf elevations 104 is three. So for given a unit module 100 which arises from ground level (and not stacked on another as shown in FIG. 12), the lowest main shelf elevation 104A is the first main level (again, 104A), the middle main shelf elevation 104B is the second main level (again, 104B), and the third main shelf elevation 104C is the third main level (again, 104C). Preferably the head-space gap 108 between main shelf elevations 104 (i.e., the respective headspace gap 108 above the first main level 104A and second main level 104B respectively in FIG. 1, there being no headspace gap above third main level 104C in FIG. 1 because there is no ceiling or upper barrier (e.g., shelf panel 102) above the third main level 104C) is sufficient to accommodate the shelving of a five gallon bucket.

However, it is an aspect of the invention that the main shelf elevations 104 can be sub-divided into split levels 114 by inter-shuffled shelf structures of shelf support beams (e.g., 122, and described more particularly below) and shelf panels/shelf webs 102.

The unit module 100 comprises for example and without limitation a framework of four vertical posts 120, six horizontal shelf-support cross beams 122, six horizontal side beams 124, and three sets of tie-beams 126, 128 and 126 which are each arranged in an X-shaped pairs and dispose flush against the left side 133, rear side 135 and right side 137 of the unit module 100. The X-shaped pairs of tie beams 126, 128 and 126 are firmly fastened to their respective facet of the unit module 100 and thereby accomplish holding the unit module 100 square in good perpendicularity.

Preferably until the top ends 142 of the vertical posts 120 are utilized for purposes described more particularly below in connection with FIGS. 12 and 13, the top ends 142 of the vertical posts 120 capped with generous resilient cushion provisions (not shown).

Again, the unit module 100 defines three main shelf levels 104A, 104B and 104C. Each shelf level 104 is characterized by a spaced pair of horizontal shelf-support cross beams 122 being apart in the "in and out" direction (i.e., depthwise direction). Each pair of shelf-support cross beams 122 for any given level 104 provides support for one shelf span 102 apiece. That is, a shelf span 102 can comprise a solid panel of monolithic material, a span of composite material, a span of metal grill or expanded metal, and so on. The preferred shelf span 102 material comprises without limitation a panel of ¼-inch thick MDF engineered wood product. The preferred size (in plan view) of the preferred shelf span 102 is forty-nine inches wide by sixteen inches deep (~1.25 m by ~0.4 m). The shelf span 102 is simply supported between the spaced shelf-support cross beams 122. That is, the spaced shelf-support cross beams 122 have top edges on which the shelf span 102 rests along the margins of the crosswise fore and aft edges.

It can be seen that the rear X-shaped pair of tie beams 128 are arranged to extend between the second and third main level 104B and 104C only, while the left and right X-shaped pairs of tie beams 126 extend fully between the first and third main levels 104A and 104C.

The horizontal side beams 124 have a main elongate run 152 flanked between spaced bent ends 154. The side beams 124 are arranged such that the bent ends 154 point inward. The bent ends 154 are fastened to the respective fore and aft shelf-support cross beams 122 for the respective shelf main level 104. The main elongate runs 152 of the side beams 124 are preferably spaced further outboard from the respective outboard edges of the respective shelf span 102. Hence the main elongate runs 152 of the side beams 124 play no role in support of the respective shelf span 102. In contrast, the bents ends 154 do in fact provide a little top surface area supporting respective shelf span 102, but just barely do so.

Figure 8:
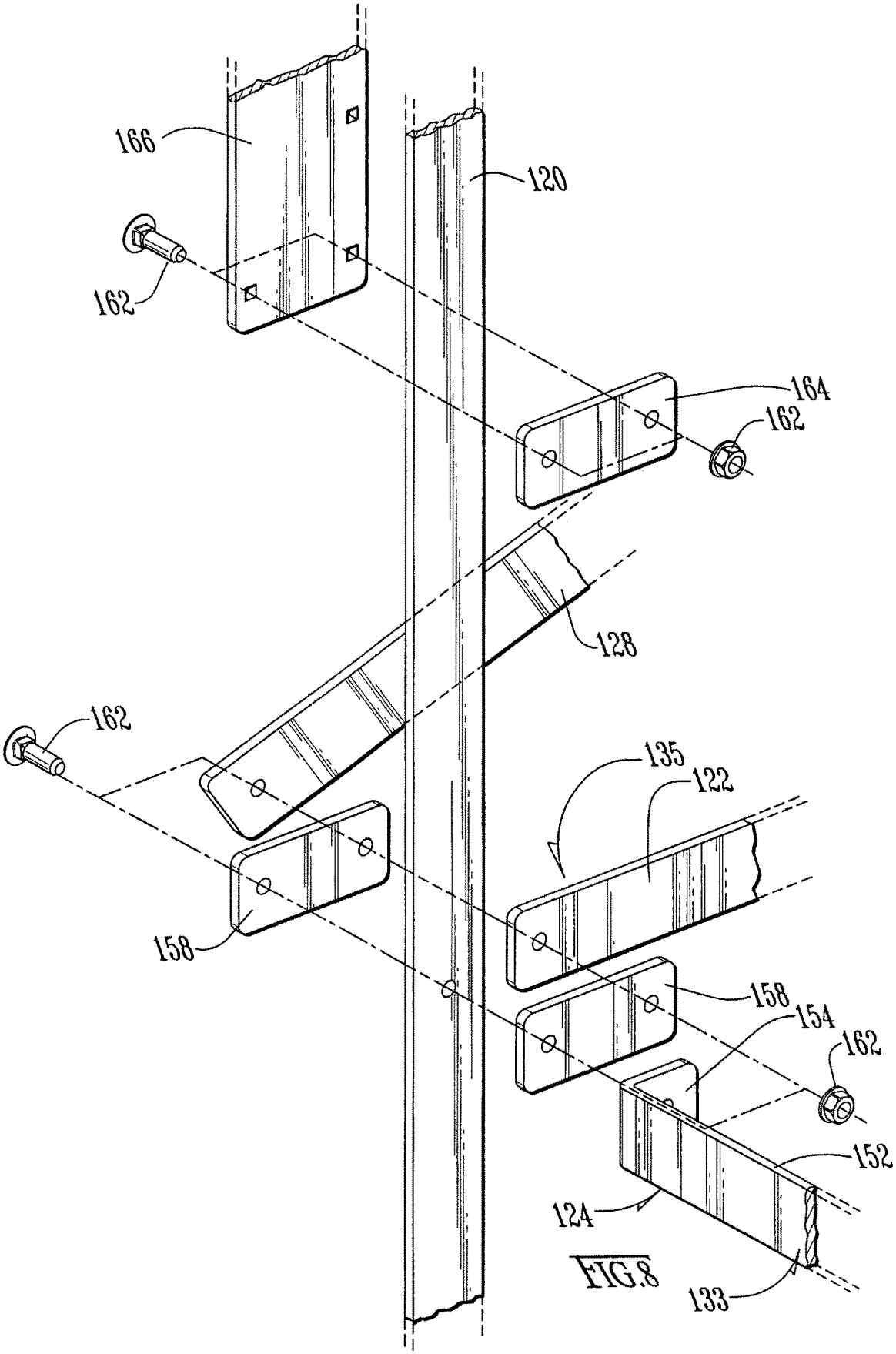
FIG. 8 is an exploded perspective view of FIG. 6.

It can be further seen the left and right X-shaped pairs of tie beams 126 fasten into the respective main elongate runs 152 of the respective left and right side beams 126 of the first and third main level 104A and 104C. The rear X-shaped pair of tie beams 128 fasten into the rear shelf-support cross beams 122 of the second and third main level 104B and 104C only. FIG. 8 shows better the preferred configuration of flat links 158 and fastener 162 for the connection at the left rear corner of the second main level 104B, as to be more particularly described below. These flat links 158 are punched with two axially-spaced holes. Hence these will be referred to as 2-hole flat links 158.

Figure 6:
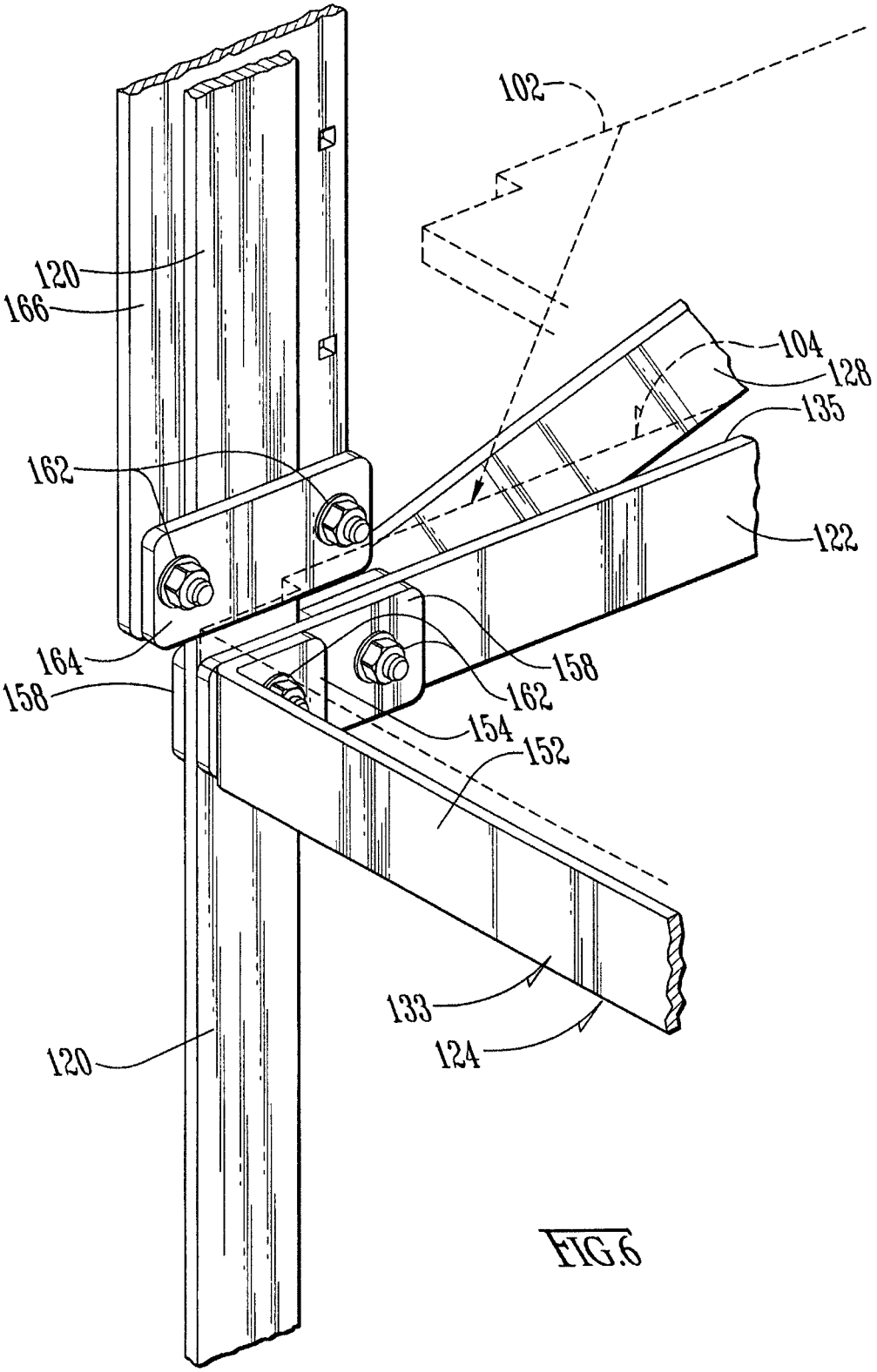
FIG. 6 is an enlarged scale perspective view of detail VI-VI in FIG. 4.
Figure 7:
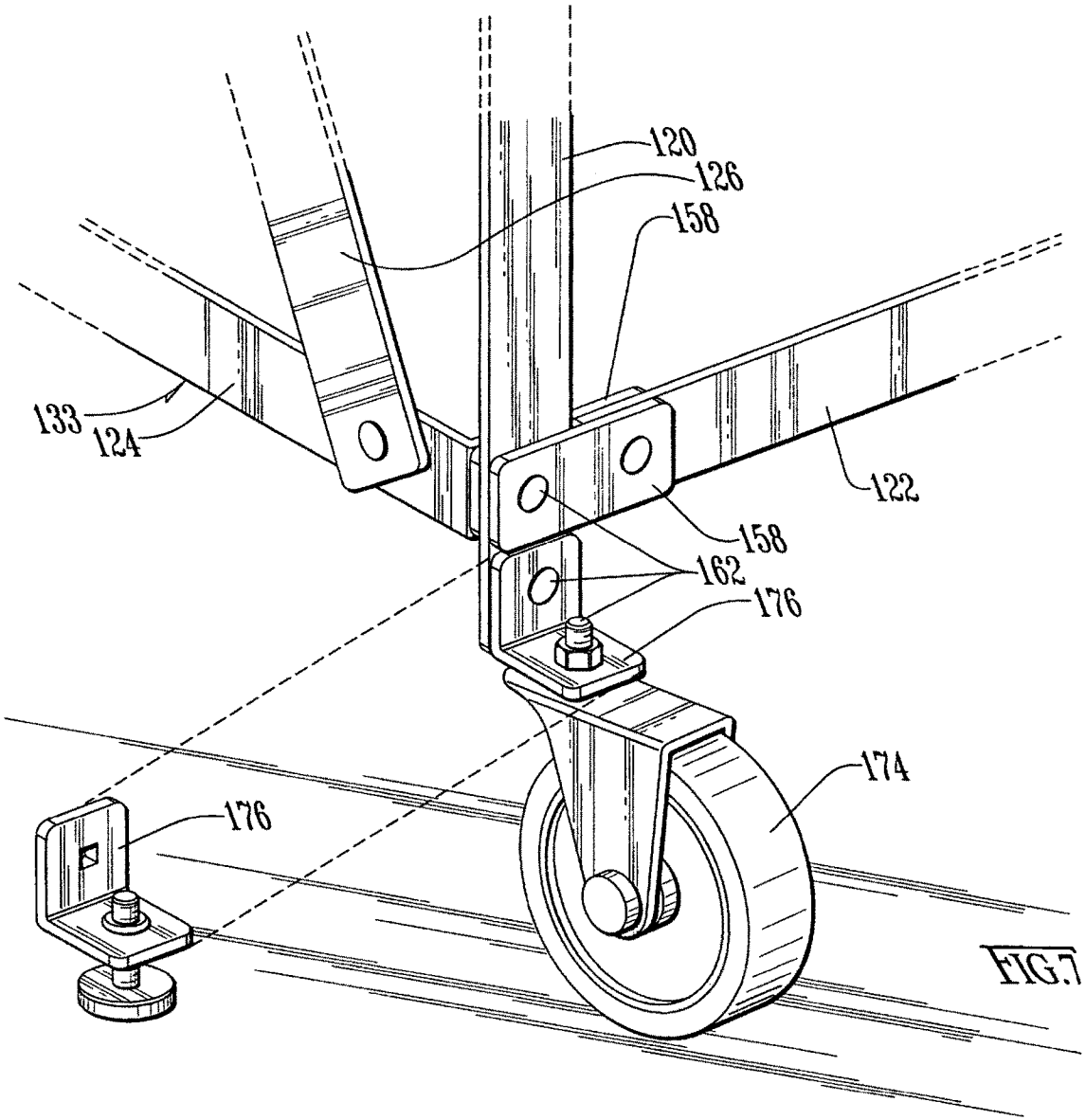
FIG. 7 is an enlarged scale perspective view of detail VII-VII in FIG. 4.

As FIGS. 6-8 show better, these 2-hole flat links 158 are used in various places in fastening at the corners of the framework where there can be any intersection of (1) vertical posts 120, (2) the ends of shelf-supporting cross beams 122 for main level shelf spans 102, (3) the ends of side beams 124, as well as optionally including (4) the ends of rear tie bars 128.

All of the vertical posts 120 have a standardized design so that any vertical post 120 is interchangeable with any other vertical post 120.

All of the elongated longitudinal shelf-support cross beams 122 have a standardized design so that any elongated longitudinal shelf-support cross beam 122 is interchangeable with any other elongated longitudinal shelf-support cross beam 122.

All of the formed (e.g., bent ends 154) horizontal side beams 124 have a standardized design so that any horizontal side beam 124 is interchangeable with any other horizontal side beam 124.

And this interchangeability is repeated with the tie beams 126 and 128, the 2-hole flat links 158 (and 3-hole flat links 178 more particularly described below), and so on with other components, so as to minimize the number of structural shapes for the several components. That way, with a generous stockpile of a few components, these components just assemble in repetitive modes to produce a shelf assembly 100, 100×2W, 100×2W×2D, 100×2W×2D×2H and so on in accordance with the invention that is expandable up to unit modules 100 assembled into an assembly 100×2W×2D×2H as much as two units 100 deep, two units 100 wide and two units 100 high (see, e.g., FIG. 12): and without limitation to further expansion.

Preferably there are only five major structural components. Preferably the components are produced of a stock material comprising either 3/16-inch by 1.5 inch or 3/16-inch by 1.0 inch mild steel flat bars. Preferably the forming of apertures and bends is accomplished by punch press operation and/or press brake operations. And more preferred still, there is no welding. All the connections, and strength achieved thereby, are accomplished by fasteners 162.

Indeed, it is an aspect of the invention that all the fastening for a single unit is accomplished by one specified fastener 162: namely, as a matter of non-limiting preference, a ¼-20×1 inch carriage bolts and flanged lock nuts. However, a common hex nut and split lock washer will substitute as well.

However, for modular expansion, a second size bolt is required, ¼-20×1.25 inch carriage bolt (e.g., a quarter inch longer, but still same preferred flanged lock nut). In the alternative, an assembly as shown in FIG. 12 can all be made with 1.25 inch long carriage bolts, thereby simplifying the assembly need to just one size of a fastener 162.

Trials to date show that the capacity for each shelf, given the foregoing components and dimensions, exceeds three hundred pounds (~135 kg) for each shelf. If the MDF thickness is increased to ½-inch thick, then trials to date show that the capacity for each shelf given the foregoing components and dimensions exceeds one-thousand pounds (N 455 kg) for each shelf.

Preferably the dimensions for each shelf span 102 (or panel 102) of MDF is selected so that six spans 102 (or panels 102) are obtained out a standard stock sheet size. The MDF industry has standardized stock sheet sizes that differ from the more familiar size used by the plywood industry. The standardized stock sheet size for MDF is one inch wider and one inch longer than four feet by eight feet standard used by the plywood industry. Thus the he standardized stock sheet size for MDF is forty-nine by ninety-seven inches. This allows the shelf-support cross beams 122 to have a give horizontal run between laterally-spaced opposite vertical posts 120 which are exactly forty-eight inches wide. Again, the width clearance between laterally-spaced opposite vertical posts 120 for the depositing and withdrawal of articles on the shelf span 102 is forty-eight inches. To be more brief, the width clearance is forty-eight inches.

Figure 1:
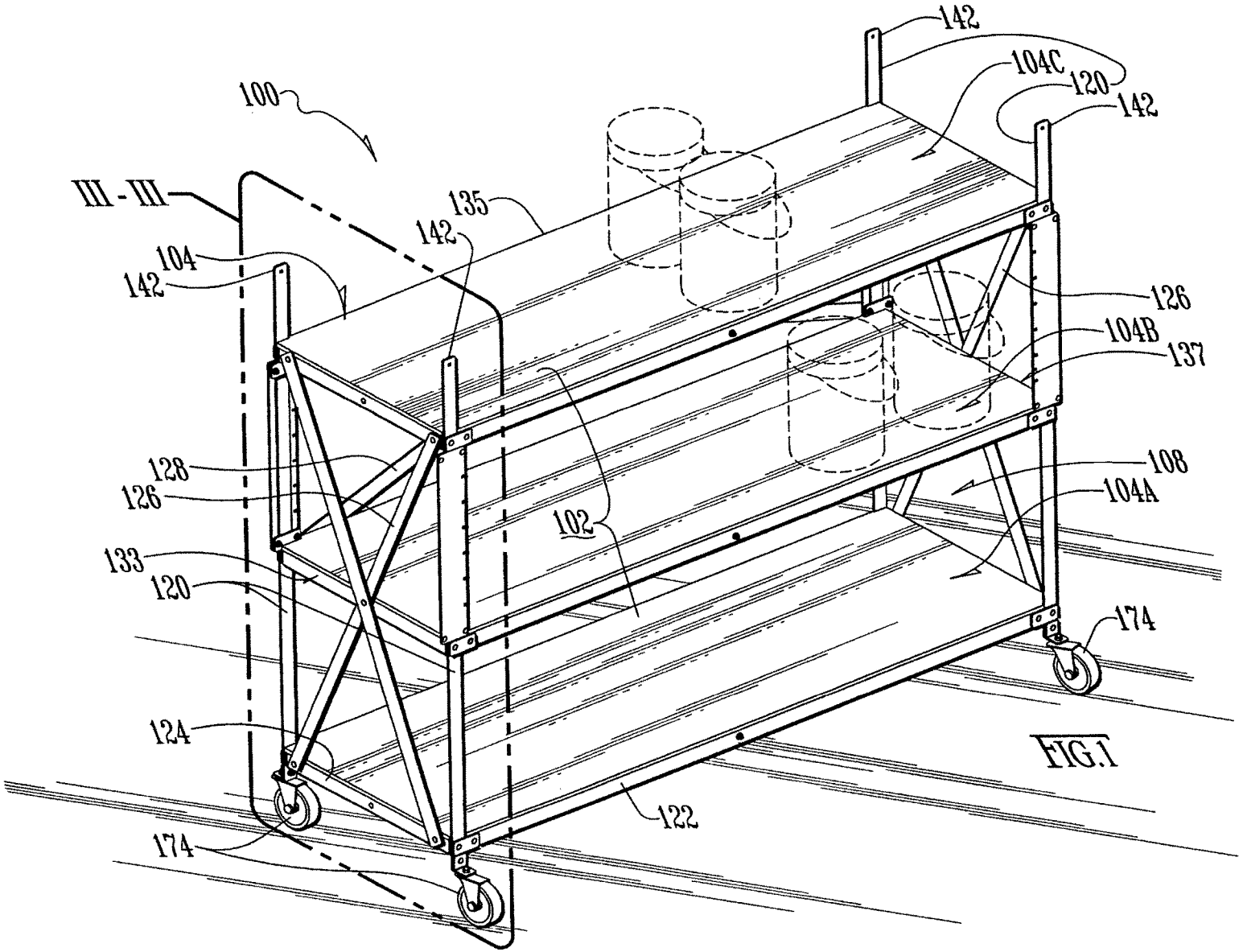
Figure 1A:
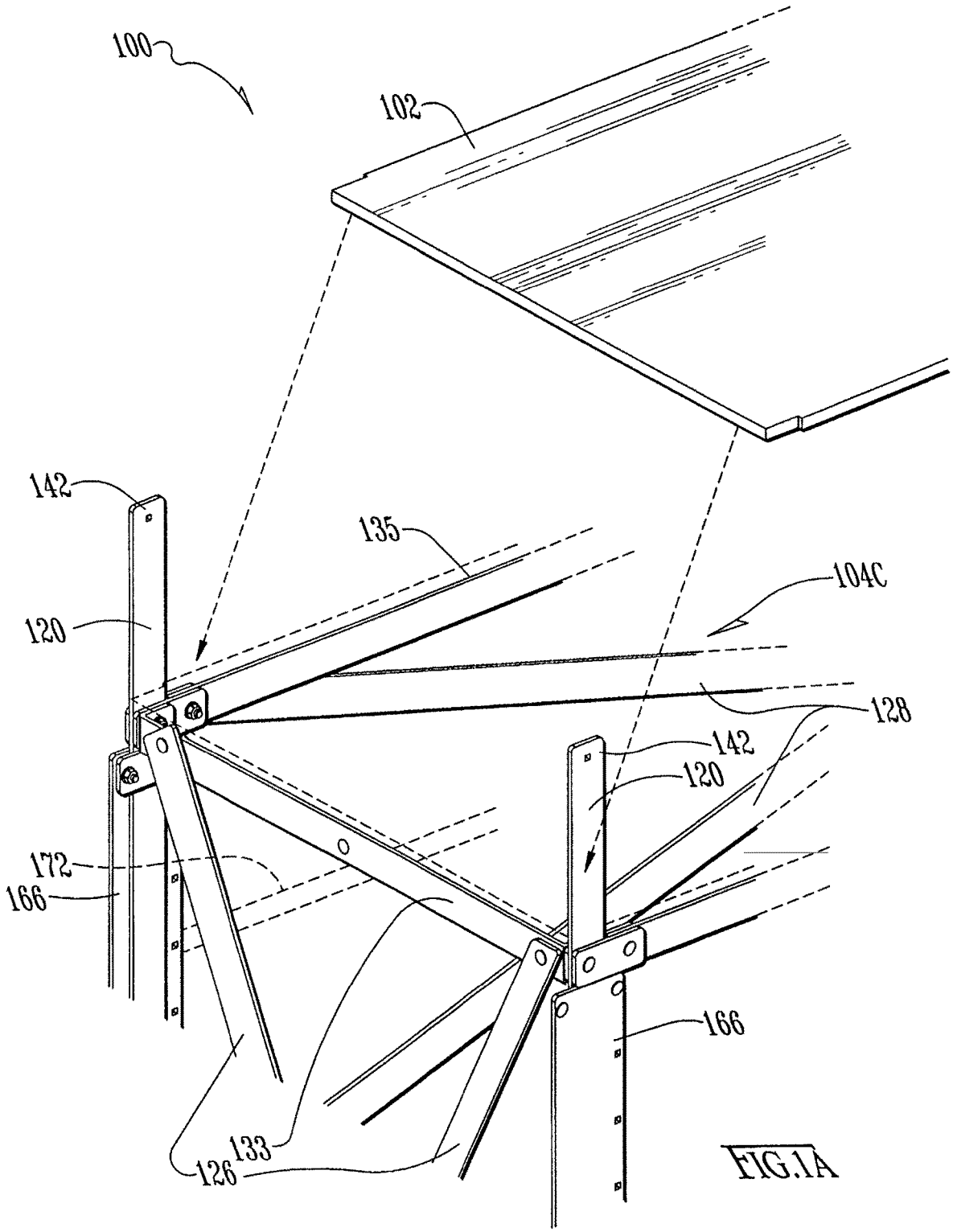
FIG. 1A is an enlarged scale perspective view of detail IA-IA in FIG. 3, except with the planar shelf panels/shelf web shown suspended in space and apart from the longitudinal shelf-supporting cross beam.

To turn to FIG. 1A, it shows that the shelf spans 102 are notched at the corners to form a tongue tab that is narrower than the sixteen inches width elsewhere for the shelf spans 102. These tongue tabs insert between and abut up against opposite fore-to-aft spaced vertical posts 120. The notching and tongue tabs leftover thereby cooperatively operate to secure the shelf spans 102 into place. But as mentioned above, the shelf spans 102 are not supported under their tongue tabs by the main elongate run 152 of the side beam 124.

It is another aspect of the invention that one worker alone, with a fork lift and a pair of wrenches, can build an assembly as shown in FIG. 12, or even a larger and larger expansion of what is shown in FIG. 12.

Preferably to do this, the worker would build his lower unit module 100 separably first, then stack an upper unit module 100 on the lower unit module 100 and pin the units 100 together with four fasteners 162 and eight flat links 158 as shown. The eight flat links 158 are already pre-installed on the lower unit module 100 before the upper unit module 100 is lifted and stacked in place.

Figure 4:
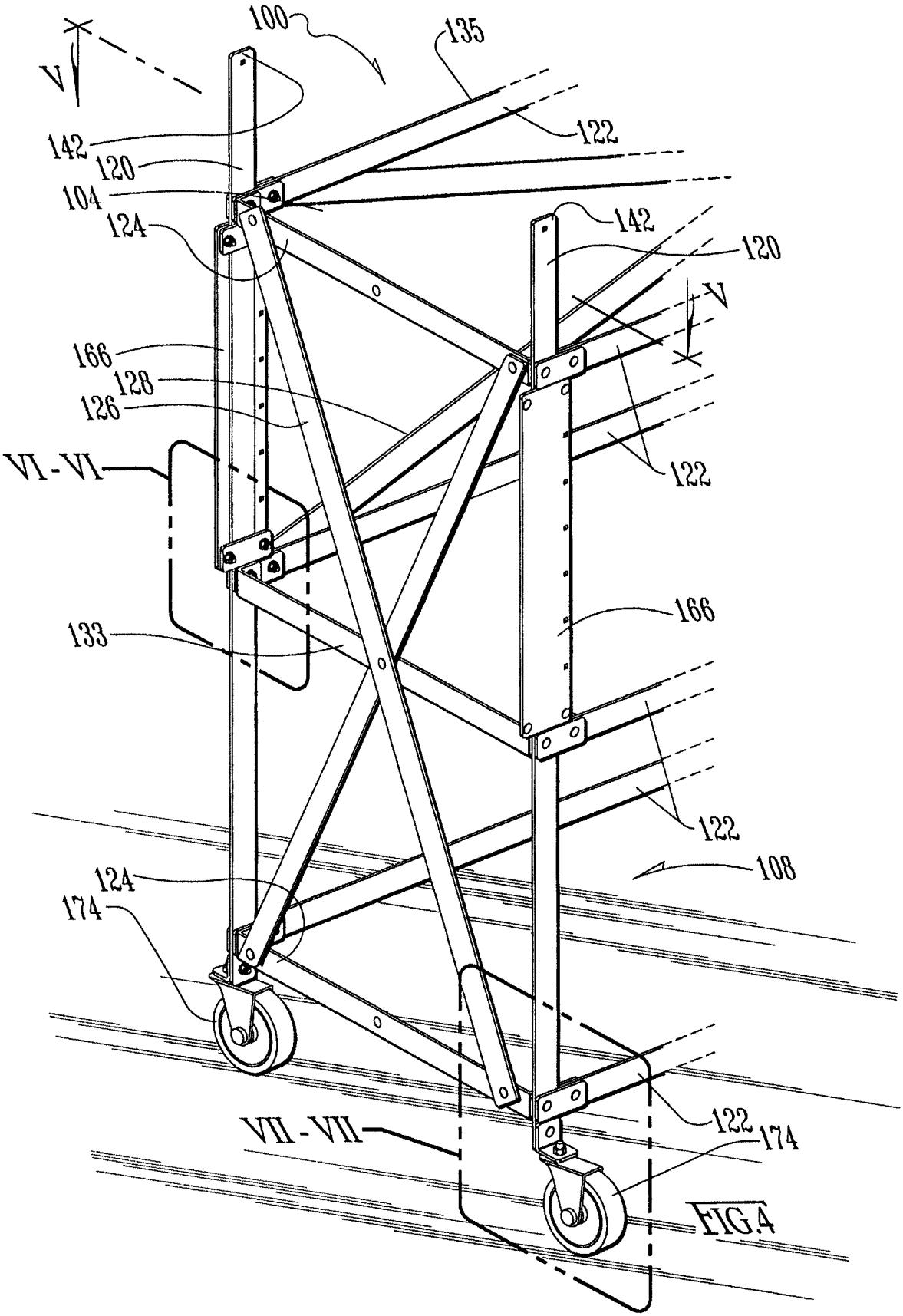
FIG. 4 is an enlarged scale perspective view of detail IV-IV in FIG. 2.
Figure 5:
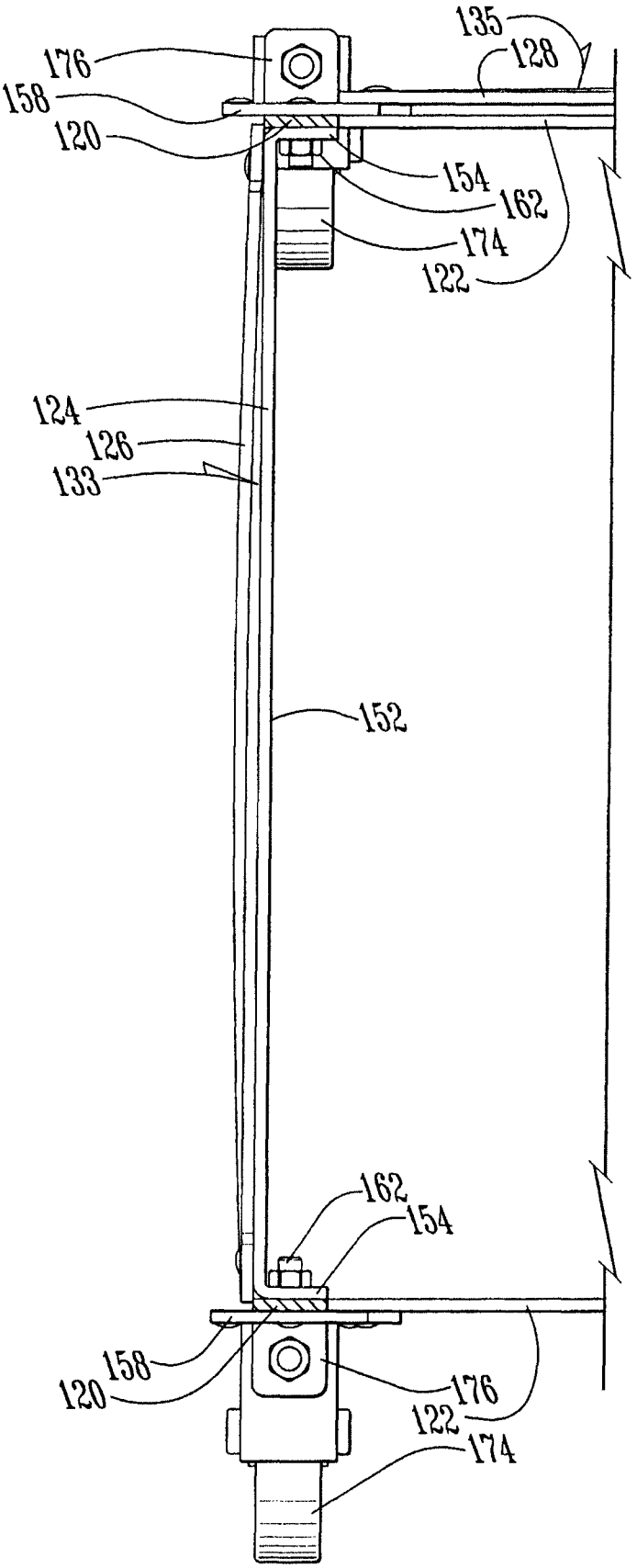
FIG. 5 is a plan view, partly in section, taken in the direction of arrows V-V in FIG. 4.

FIG. 6 is an enlarged scale perspective view of detail VI-VI in FIG. 4.

FIG. 8 is an exploded perspective view of FIG. 6. FIG. 8 shows a vertical post 120, the bent end 154 of side beam 124 (i.e., vertical post 120 fore-to-aft spacer), two flat links 158, a clamp band 164 that differs from the 2-hole flat links 158 in being (1) a little longer and (2) because it differs in its function. FIG. 8 further shows an end of one tie beam 128 and an end of one shelf-support cross beam 122, plus two carriage bolts and two flanged lock nuts (e.g., fasteners 162).

Figure 2:
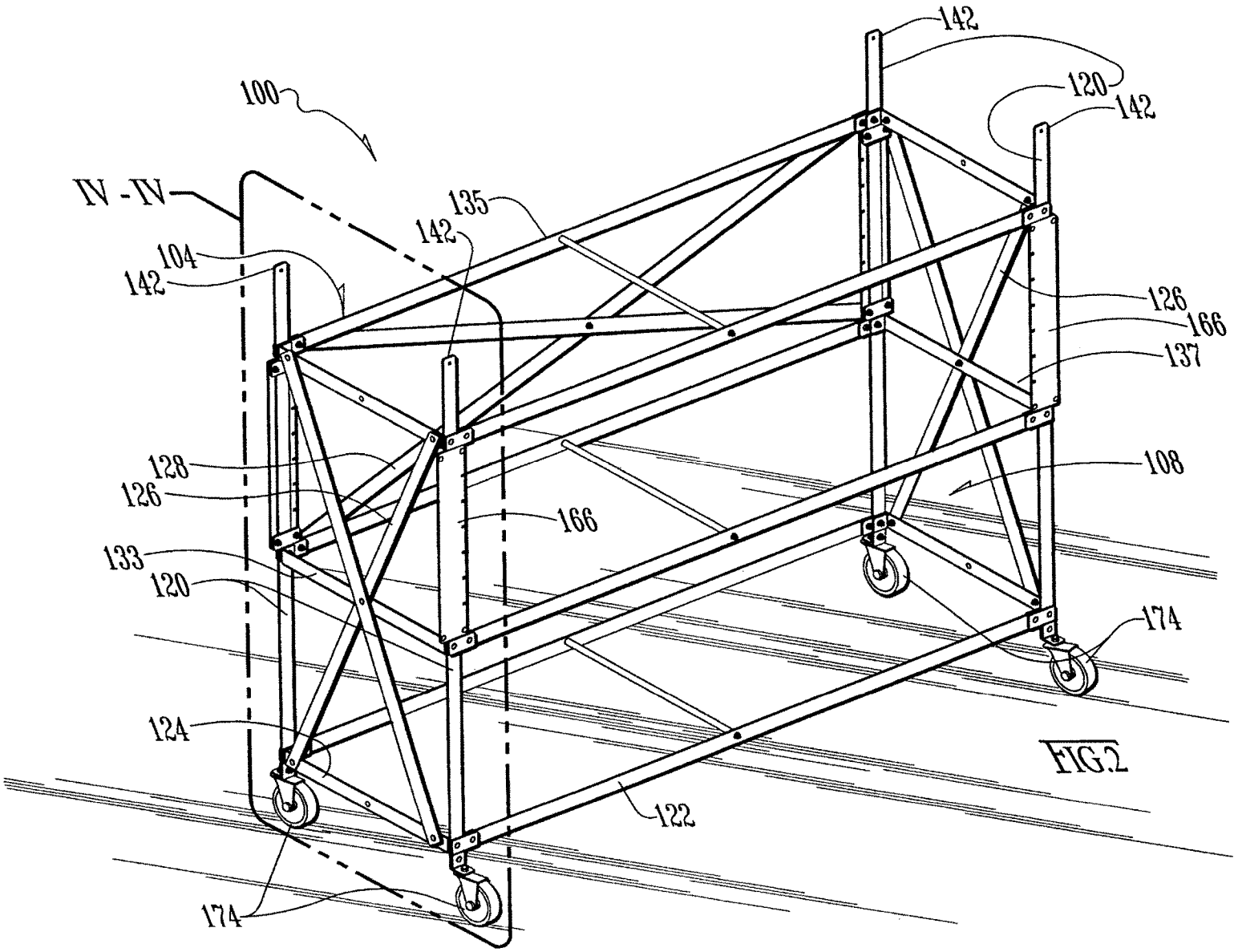
FIG. 2 is a perspective view comparable to FIG. 1 except with the planar shelf panels/shelf webs removed from view.

In addition, FIG. 8 shows the lower end of one laser cut faceplate 166 with a column of adjustment holes for accepting ¼-inch carriage bolts 162. FIGS. 1 and 2 show better that there are four such faceplates 166 disposed facing the respective outboard surface of the four vertical posts 120 but only between the second and third main level 104B and 104C. FIGS. 3, 4, 6 and 8 might show better that these faceplates 166 are clamped in place to each faceplate 166's respective vertical post 120 by an upper and lower clamp band 164, and then two fasteners 162 apiece for each clamp band 164.

Again the faceplates 166 are formed with, and thus present inside the vertical posts 120, a vertical column of adjustment holes for accepting ¼-inch carriage bolts 162. It is an object of the invention to provide a second configuration of shelf-supporting cross beams 172 which in contrast are relatively slenderer than the shelf-supporting cross beams 122 used for the main levels 104.

That is, the aforementioned 3/16-inch by 1.5 inch mild steel flat bars are used for producing (1) the vertical posts 120, (2) the side beams 124, (3) the flat links 158 and (4) the shelf-supporting cross beams 122 used for the main levels 104. In contrast, the aforementioned 3/16-inch by 1.0 inch mild steel flat bars are used to produce (1) the tie beams 126 and 128, (2) the clamp bands 164 and (3) the second configuration of shelf-supporting cross beams 172. The laser cut faceplates 166 are produced from 3/16-inch by 2.5 inch mild steel flat bars.

The second configuration of shelf-supporting cross beams 172 can be aptly referred to as mid-level cross beams 172. Hence the mid-level cross beams 172 are a half inch slenderer than the main level cross beams 122. The mid-level cross beams 172 are fastened by one carriage bolt 162 alone at each end to a respective faceplate 166. The mid-level cross beams 172 can be vertically spaced from the main level below (e.g., 104B in FIG. 3), and correspondingly from the main level above (e.g., 104C in FIG. 3), by selecting any of the index holes in the faceplates 166 through which to fasten the ends of the mid-level cross beams 172. The mid-level cross beams 172 accept the same configuration of shelf spans 102 (same configuration of shelf panels 102) as do the main level cross beams 122.

Figure 3:
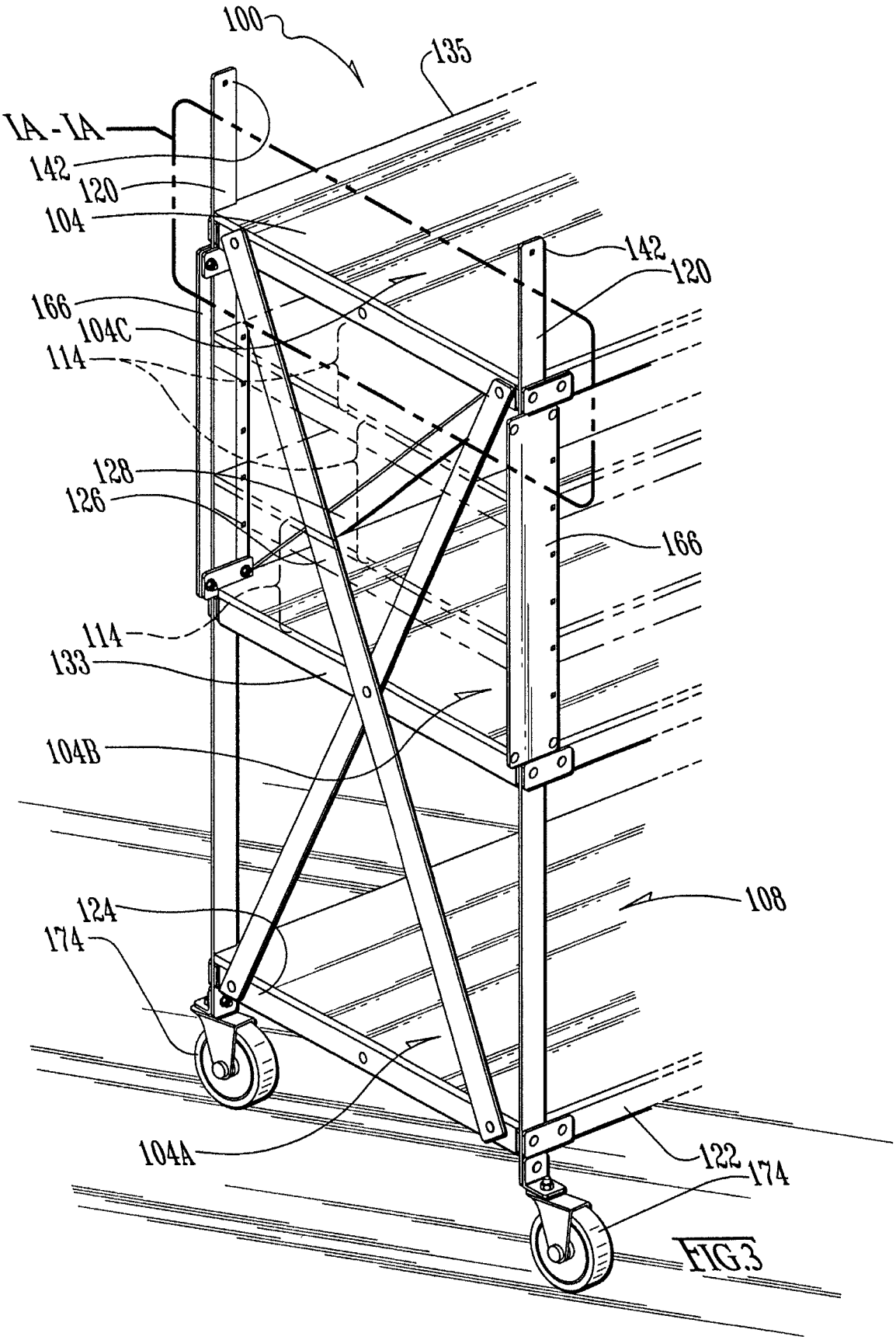
FIG. 3 is an enlarged scale perspective view of detail III-III in FIG. 1.

Given the foregoing, FIGS. 1-3 show instances where the second main shelf level 104B's headspace gap 108 is partitioned in two or three by two or three mid-level shelf spans 102 resting on fore-to-aft spaced mid-level cross beams 172. But as before, the left and right sides of the mid-level shelf spans 102 are unsupported.

FIG. 7 is an enlarged scale perspective view of detail VII-VII in FIG. 4. This view provides a close-up view of how the bottom end of vertical post 120 can be equipped with a caster wheel 174. The caster wheel 174 is an OEM product from elsewhere. But ell-shaped adapter 176 is another aspect of the invention. The ell-shaped adapter 176 is produced of the same 3/16-inch by 1.5 inch mild steel flat bars as used for the vertical posts 120.

Figure 9:
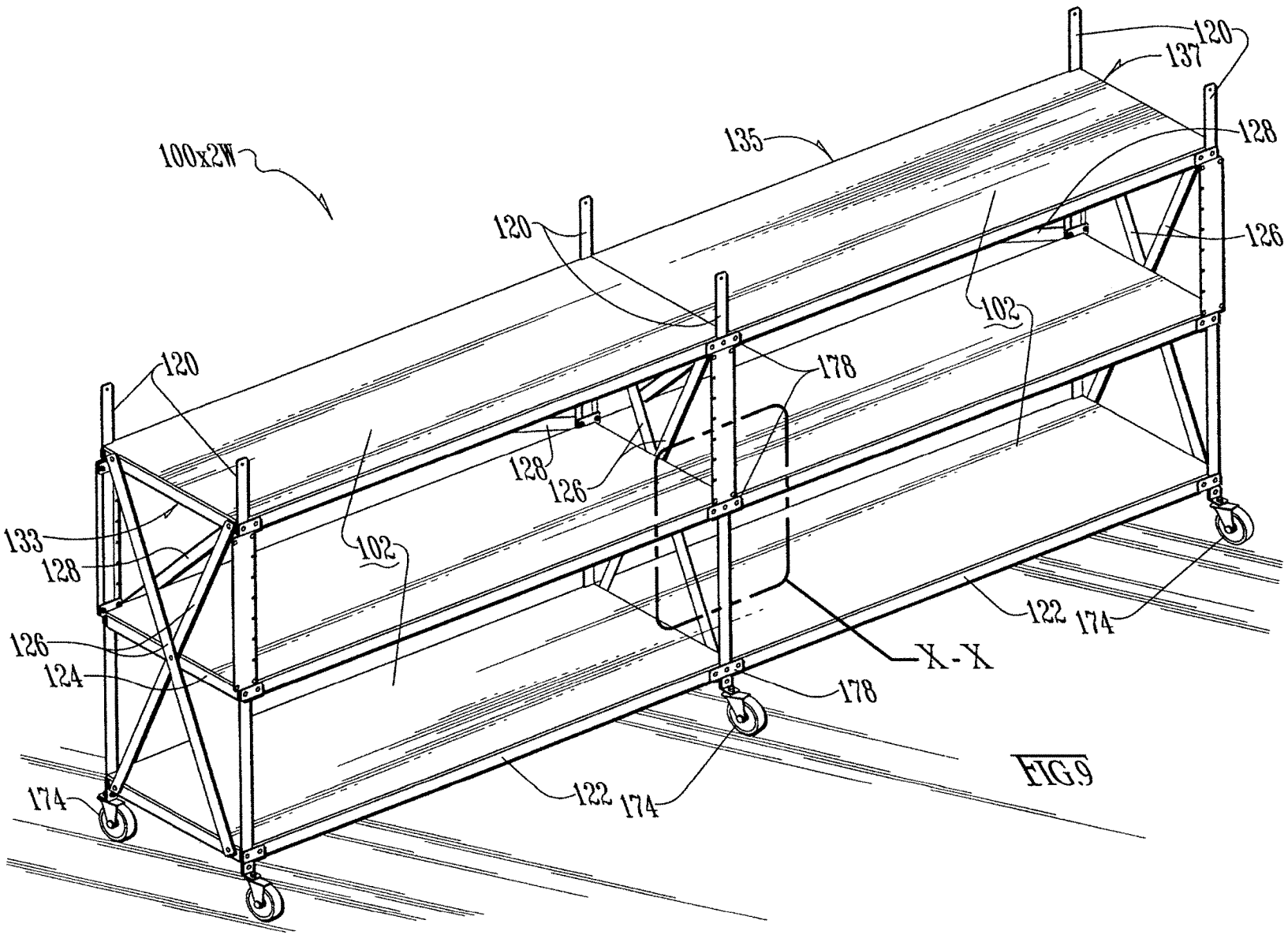
FIG. 9 is a perspective view comparable to FIG. 1 except showing the process of lateral modular expansion of the lone unit module shown in FIG. 1 by expansion into a second embodiment of a modular shelf assembly in accordance with the invention, accomplished by combining of a pair of such unit modules side-by-side to each other (e.g., a modular shelf assembly which is two units wide)
Figure 10:
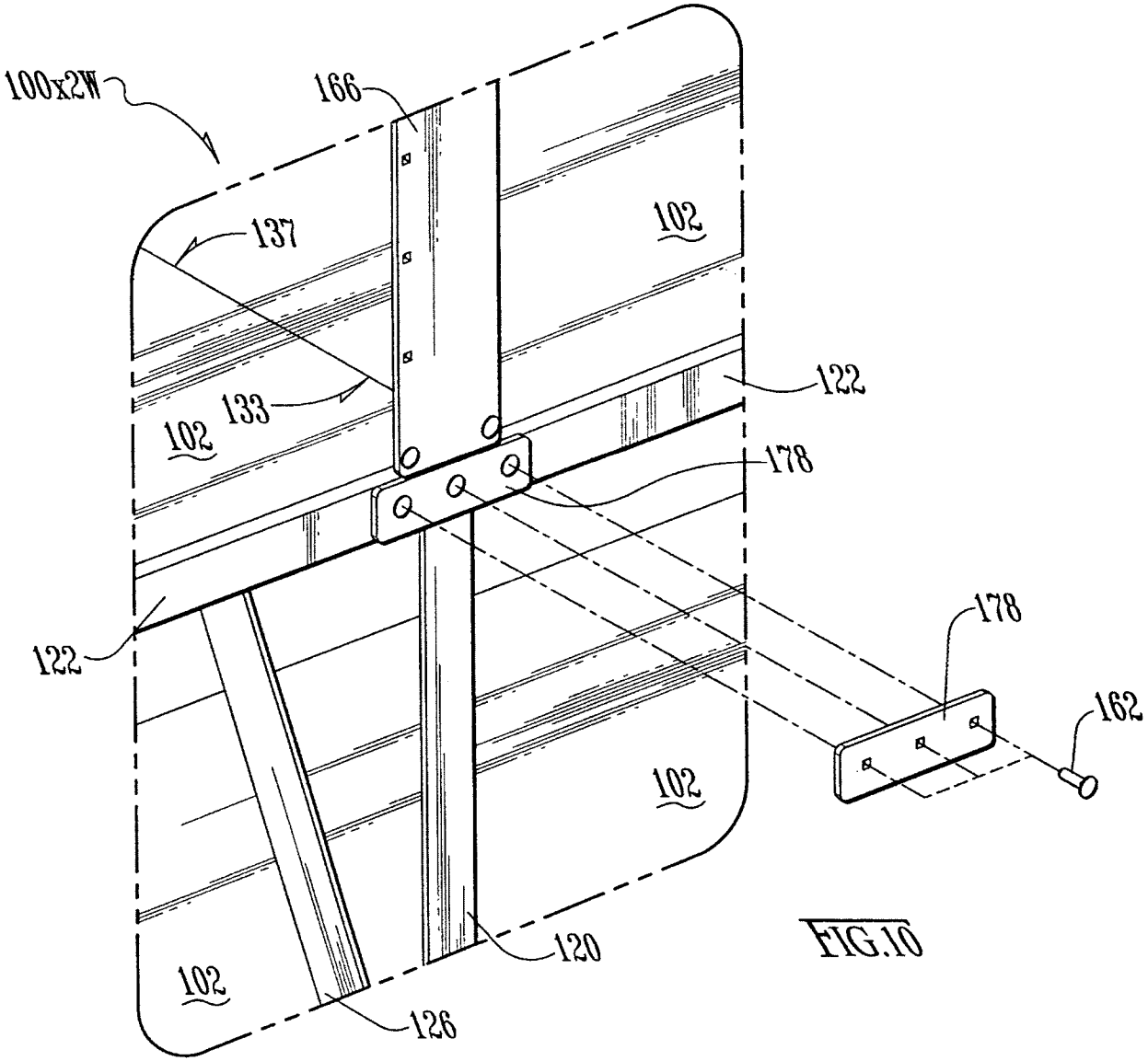
FIG. 10 is an enlarged scale perspective view of detail X-X in FIG. 9.

FIG. 9 is a perspective view comparable to FIG. 1 except showing the process of lateral modular expansion of the lone unit module 100 shown in FIG. 1 by expansion into a second embodiment of a modular shelf assembly 100×2W in accordance with the invention, accomplished by combining of a pair of such unit modules 100 side-by-side to each other (e.g., a modular shelf assembly 100×2W which is two units wide). FIG. 10 is an enlarged scale perspective view of detail X-X in FIG. 9.

FIGS. 9 and 10 show that lone unit module 100 of FIG. 1 is laterally expanded side-by-side with another unit module 100 by each sharing the central pair of fore-to-aft spaced vertical posts 120 in common. Hence this second embodiment of a modular shelf assembly 100×2W is characterized by six vertical posts 120 arranged in an array of three posts 120 across times two posts 120 deep in the array. Again, the central pair of vertical posts 120 is shared between the left and right units 100.

FIG. 10 shows better that this second embodiment of a modular shelf assembly 100 is enabled by an additional component, and that being a 3-hole flat link 178. The spacing between the center hole and each outboard hole in the 3-hole flat link 178 is the same spacing as between the two holes in the 2-hole flat link 158. And the 3-hole flat link 178 is longer correspondingly proportionately relative to the 2-hole flat link 158. The 3-hole flat link 178 is produced from the same 3/16-inch by 1.5 inch mild steel flat bars as used for the 2-hole links 158, the vertical posts 120 and so on.

Figure 11:
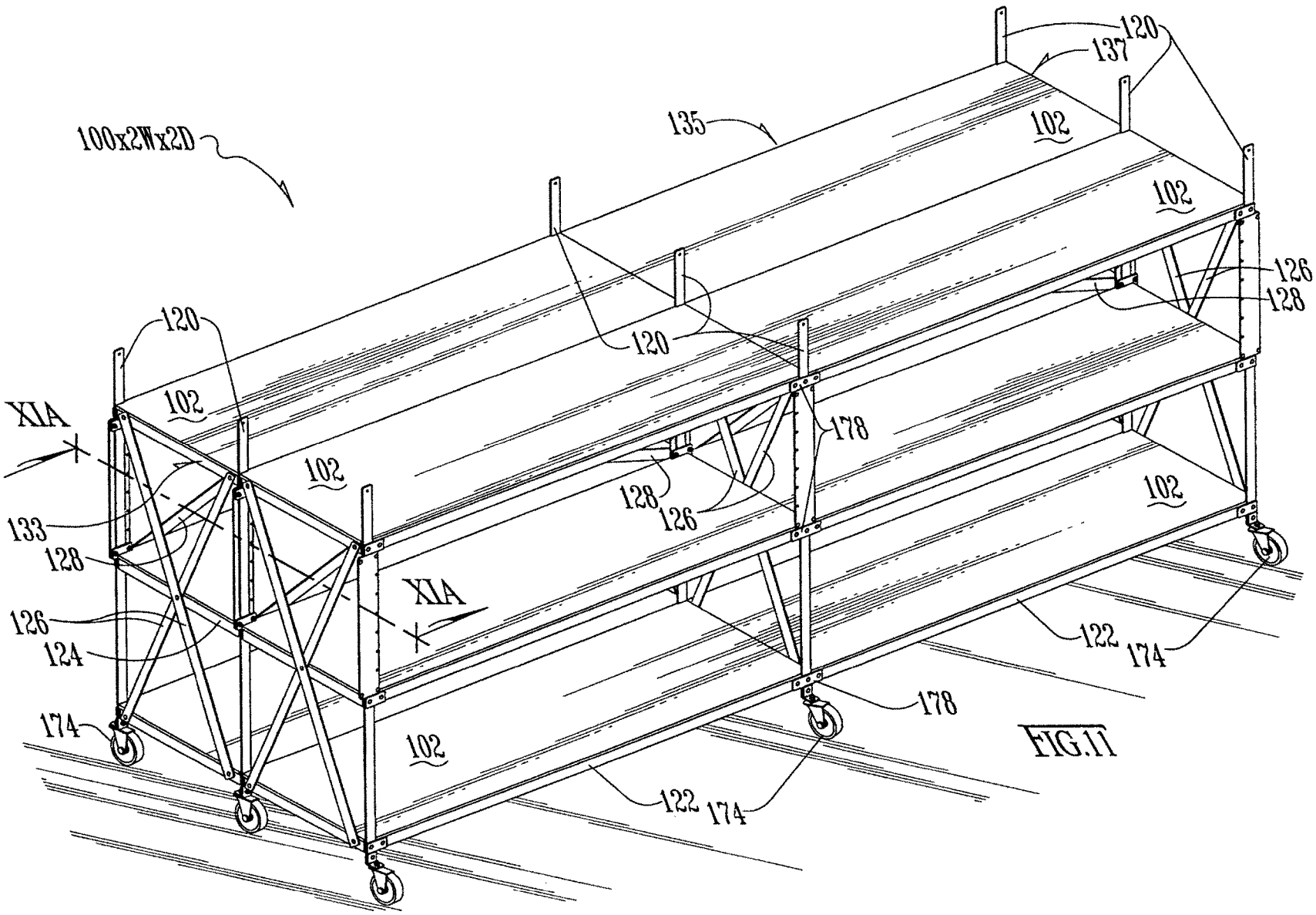
FIG. 11 is a perspective view comparable to FIG. 9 except showing the depth-wise modular expansion of the second embodiment modular shelf assembly shown by FIG. 9 into a third embodiment of a modular shelf assembly in accordance with the invention, as accomplished by combining of a pair of such second embodiment modular shelf assemblies in a front to back file (e.g., queue) relative to each other (e.g., a modular shelf assembly which is two units wide and two units deep)

FIG. 11 is a perspective view comparable to FIG. 9 except showing the depth-wise modular expansion of the second embodiment modular shelf assembly 100×2W shown by FIG. 9 into a third embodiment of a modular shelf assembly 100×2W×2D in accordance with the invention, as accomplished by combining of a pair of such second embodiment modular shelf assemblies 100×2W in a front to back file (e.g., queue) relative to each other (e.g., a modular shelf assembly 100×2W×2D which is two units wide and two units deep).

This third embodiment of a modular shelf assembly 100×2W×2D is characterized by nine vertical posts 120 arranged in an array of three vertical posts 120 across time three vertical posts 120 deep in the array.

Figure 11A:
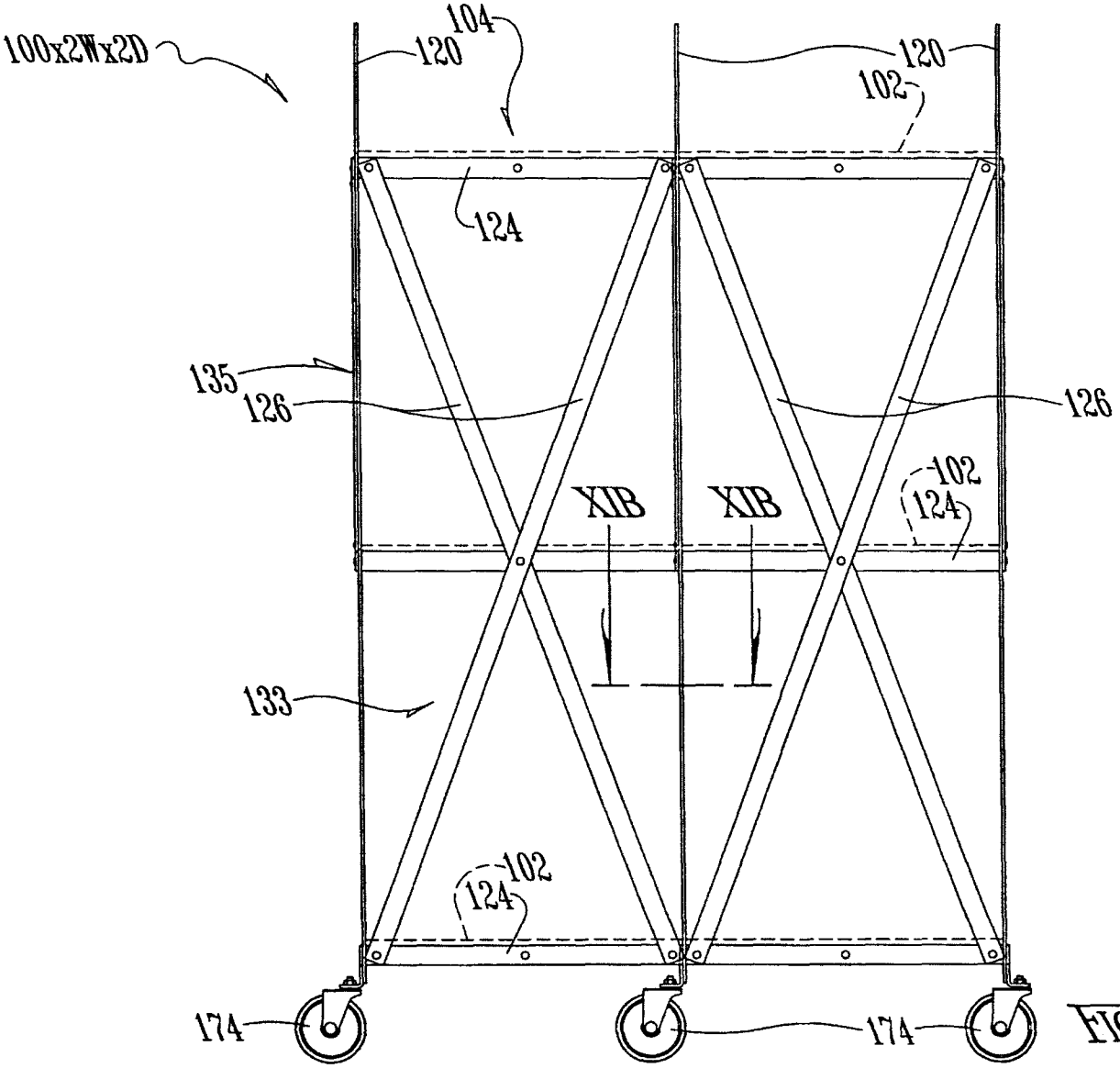
FIG. 11A is an enlarged scale side elevational view taken in the direction of arrows XIA-XIA in FIG. 11.

FIG. 11A is an enlarged scale side elevational view taken in the direction of arrows XIA-XIA in FIG. 11.

Figure 11B:
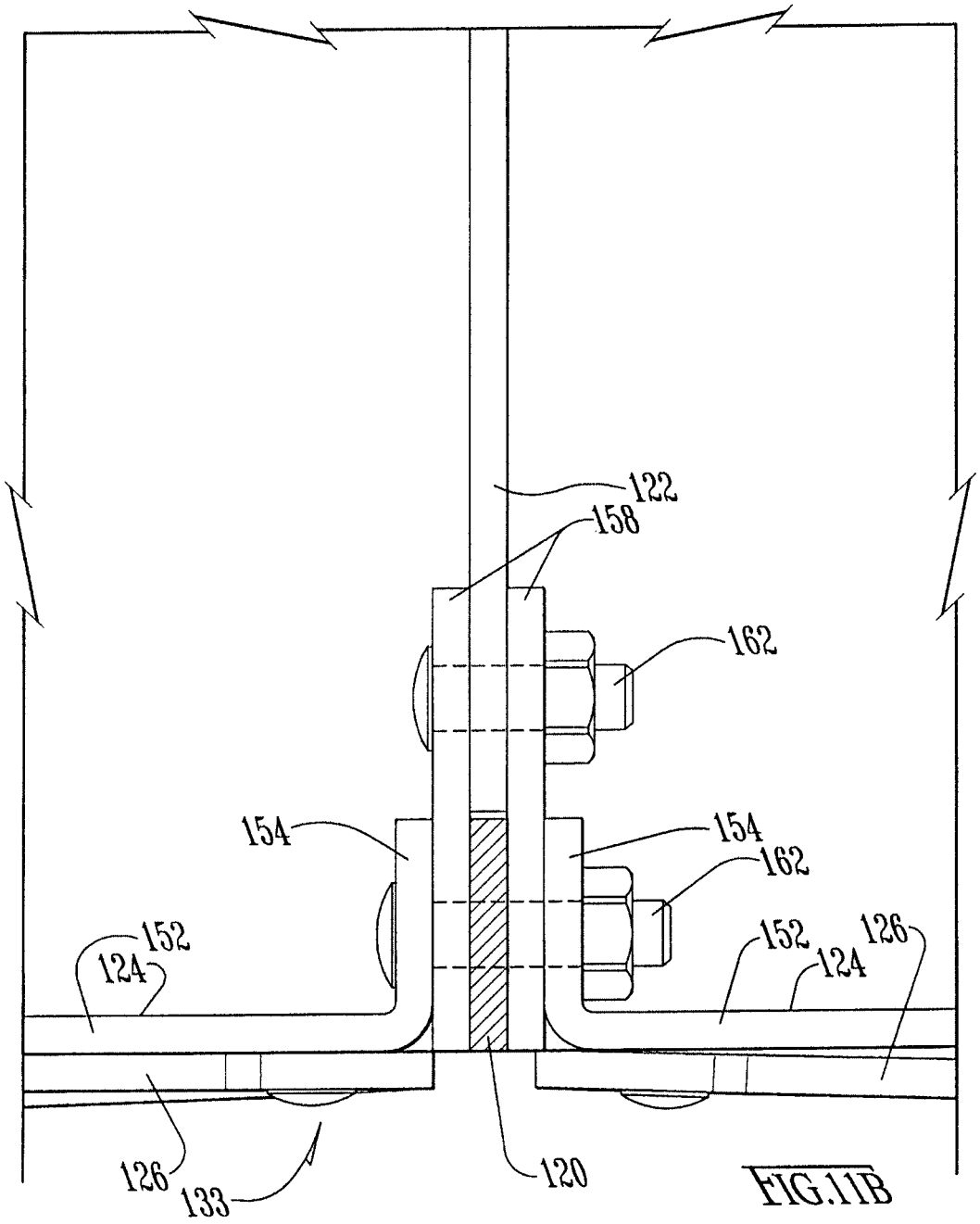
FIG. 11B is a plan view, partly in section, taken in the direction of arrows XIB-XIB in FIG. 11A.

FIG. 11B is a plan view, partly in section, taken in the direction of arrows XIB-XIB in FIG. 11A, and shows better how that one modular unit 100 aligned front to back with another modular unit 100 can share common shelf-supporting cross beams 122 between the two units 100. Also, the one modular unit 100 aligned front to back with the other modular unit 100 moreover share common vertical posts 120. The outboard two posts 120 are flanked by 2-hole flat links 158 as shown in FIG. 11B. This view also shows that lower carriage bolt 162 (lower in this view) is the special instance requiring at least a 1.25 inch long carriage bolt (162), rather than a 1.0 inch carriage bolt (162) as universally elsewhere, including for the upper bolt in this view. The central post 120 for FIG. 11 would require a 3-hole flat link 178 where FIG. 11B shows a 2-hole flat link 158, and again a 1.25 inch carriage bolt (162) (but this is not shown).

FIG. 12 is a perspective view comparable to FIG. 11 except showing the stacking-wise modular expansion of the third embodiment modular shelf assembly 100×2W×2D shown by FIG. 11 into a fourth embodiment of a modular shelf assembly 100×2W×2D×2H in accordance with the invention, as accomplished by stacking a pair of such third embodiment modular shelf assemblies 100×2W×2D one on top of the other (e.g., a modular shelf assembly 100×2W×2D×2H which is not only two units 100 wide and two units 100 deep but also two units 100 high).

This third embodiment of a modular shelf assembly 100×2W×2D×2H is characterized by eighteen vertical posts 120 arranged in a two story structure comprising:

a first story arranged in an array of three vertical posts 120 across times three vertical posts 120 deep;

and, on top of the first story, a second story arranged in an array of three vertical posts 120 across times three vertical posts 120 deep.

Wherein, the bottom ends of the array of the vertical posts 120 of the second story arise out of and are fastened to the respective counterpart top ends 142 of the three vertical posts 120 across times three vertical posts 120 deep array of the first story.

Figure 13:
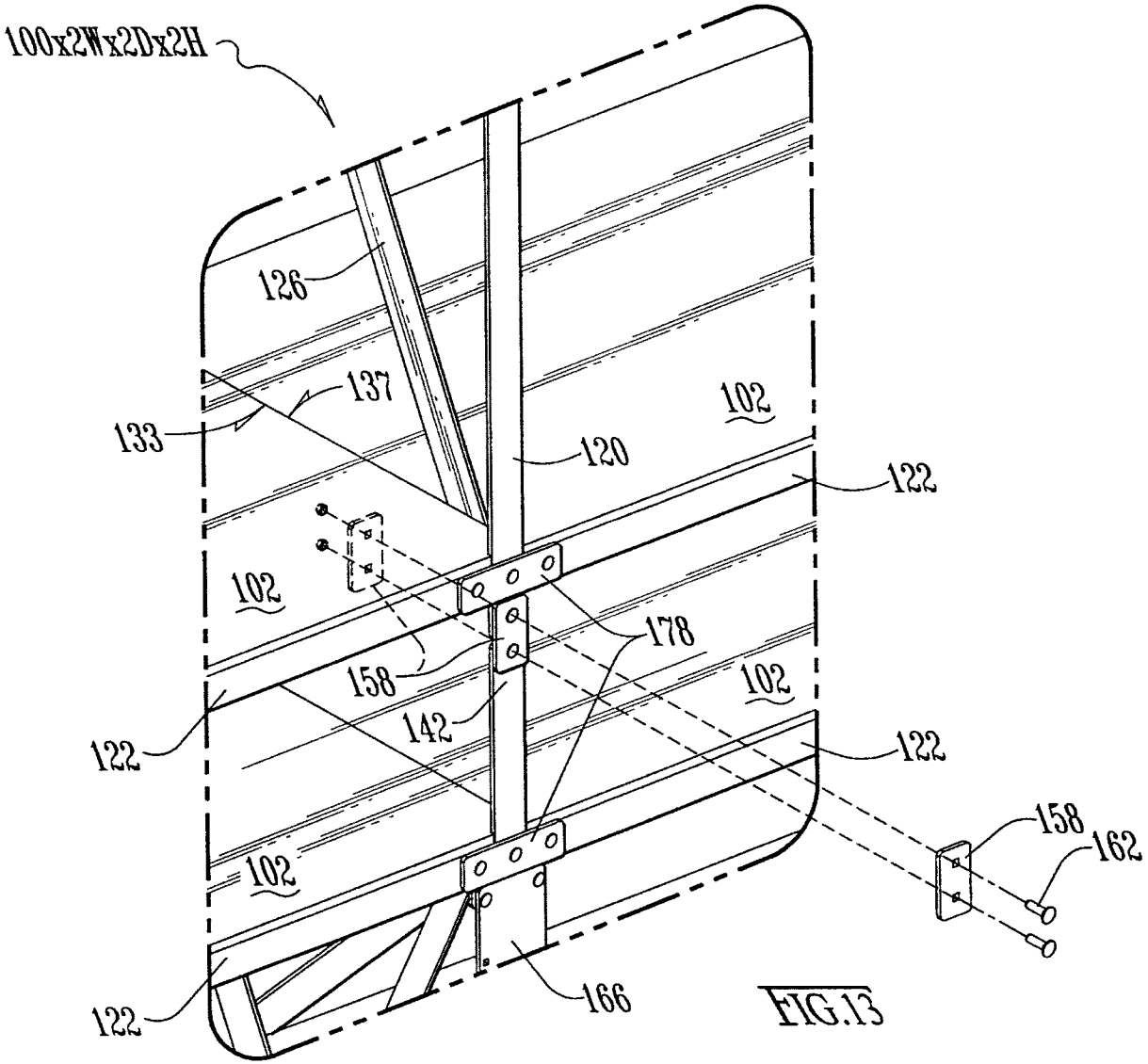
FIG. 13 is an enlarged scale perspective view of the detail XIII-XIII in FIG. 12.
Figure 14:
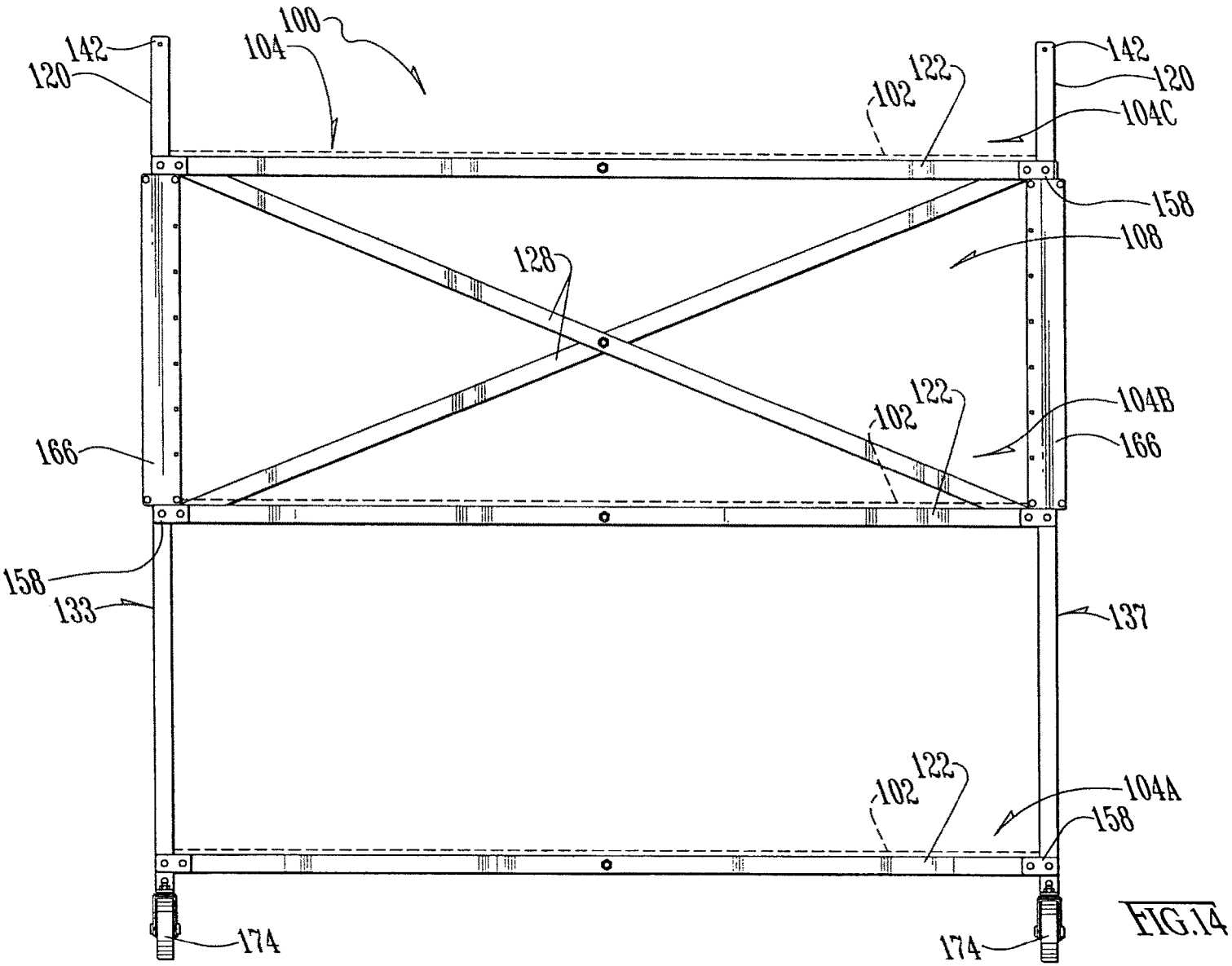
FIG. 14 is a front elevational view of FIG. 2.
Figure 15:
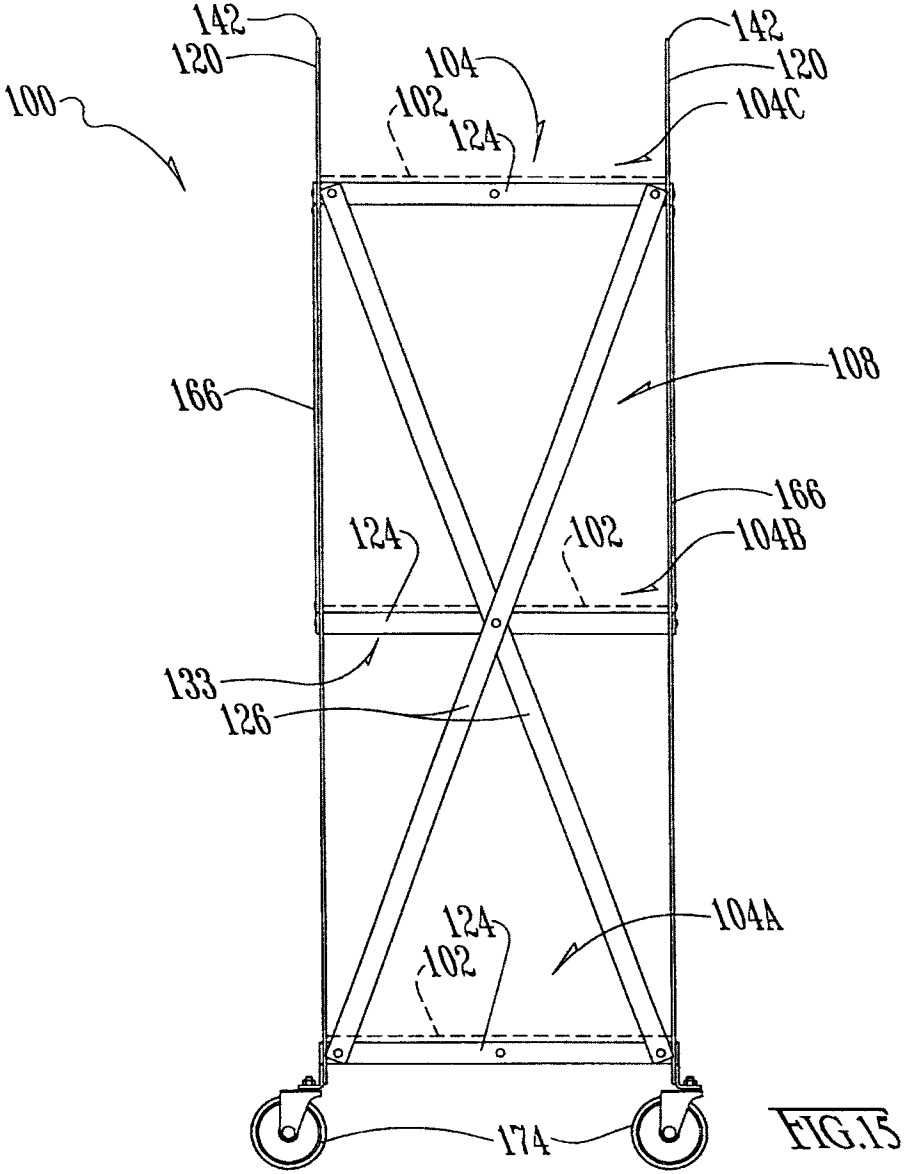
FIG. 15 is a right side elevational view of FIG. 2.
Figure 16:
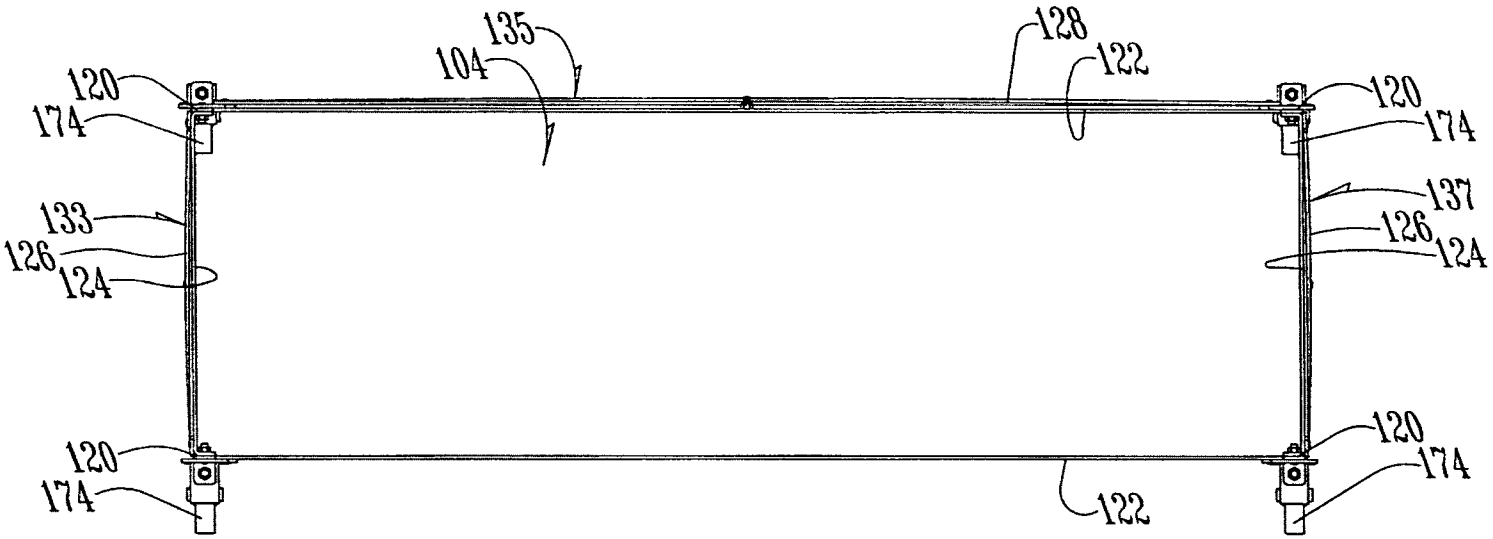
FIG. 16 is a top plan view of FIG. 2.
Figure 17:
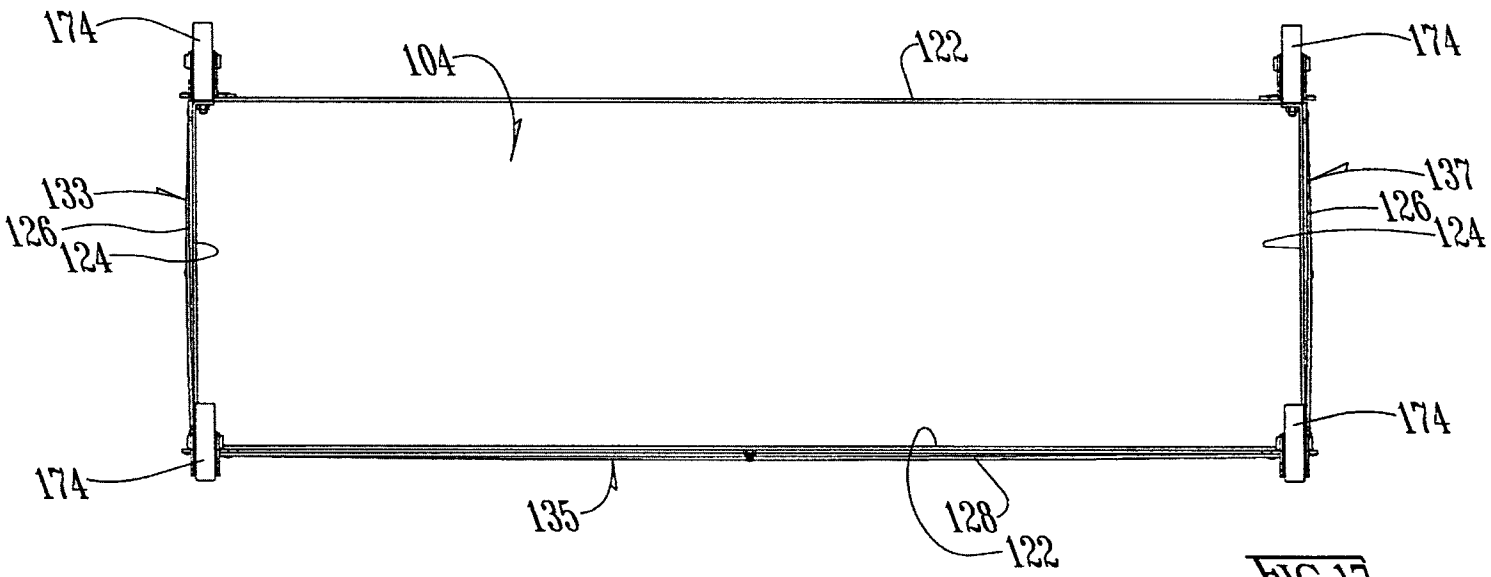
FIG. 17 is a bottom plan view of FIG. 2.
Figure 18:
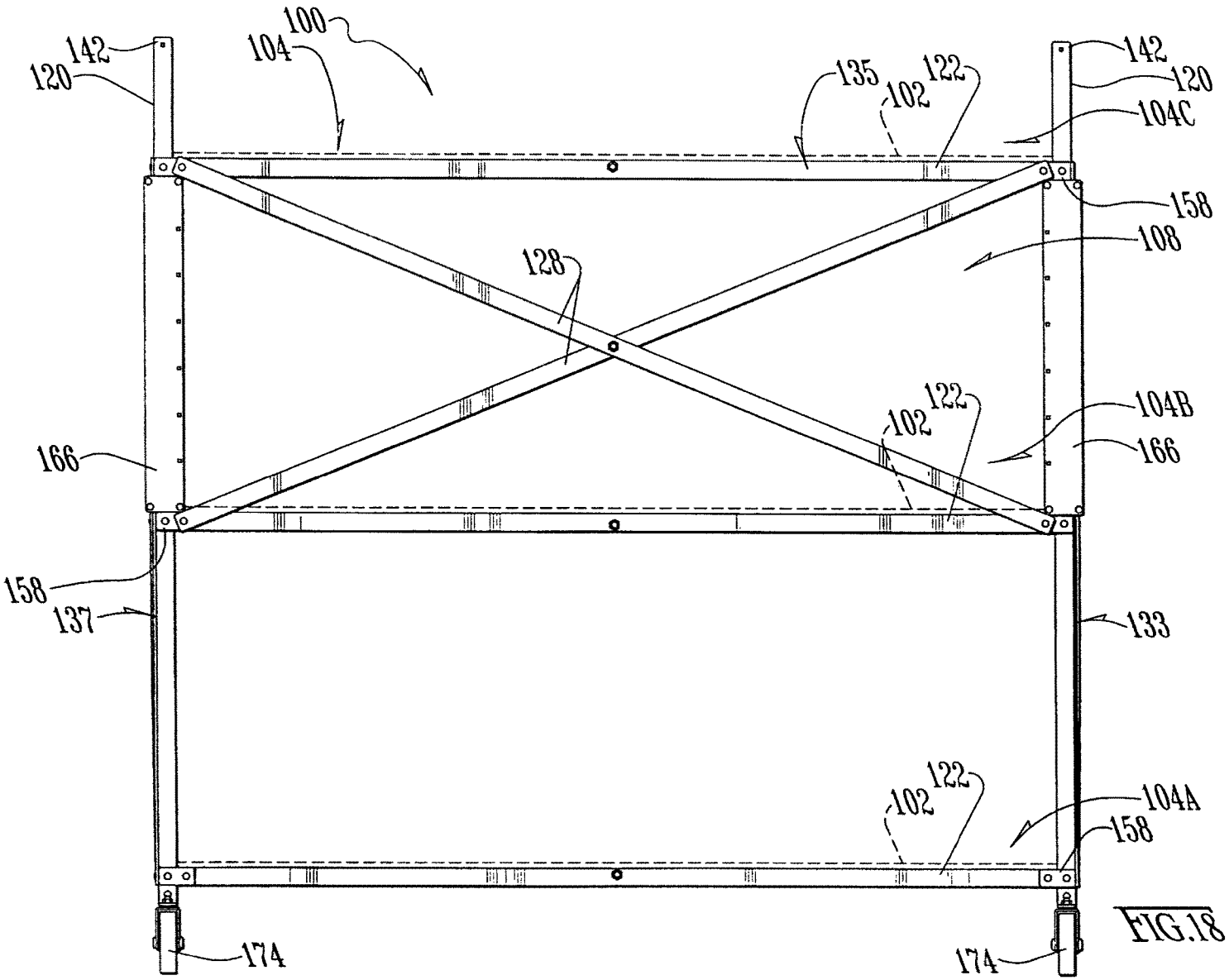
FIG. 18 is a rear elevational view of FIG. 2.

FIG. 13 is an enlarged scale perspective view of the detail XIII-XIII in FIG. 12, and shows better how the top end 142 of a lower vertical post 120 is disposed and fastened relative to the bottom end of an upper vertical post 120. This is expediently accomplished with a 2-hole flat link 158.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. In combination with a supply of a single size common fastener as well as with a supply of generally flat planar forms trimmed to generally rectangular shapes to serve as shelf panels, expandable modular shelf assembly comprising:

a stock in various numbers of at least five flat metal bar stock components, consisting of:

elongate flat vertical posts, elongate flat horizontal cross beams, horizontal side beams, wherein each side beam has a main elongate run flanked between spaced bent ends contained in a common horizontal plane whereby the each side beam has a U-shaped in plan form, elongate flat side tie-beams arranged in X-shaped pairs, and plural hole flat links for making various connections.

2. The combination of claim 1, further comprising:

a modular unit comprising four of the elongate flat vertical posts arranged in a 2×2 quadrilateral array and at least three pairs of the elongate flat horizontal cross beams;

each pair of elongate flat horizontal cross beams being fastened to the four elongate flat vertical posts in a common elevation as well as in a fore-to-aft spacing;

the at least three pairs of elongate flat horizontal cross beams being fastened to the four elongate flat vertical posts at least three vertically spaced elevations; and at least three shelf members, one each for resting across one of the at least three pairs of elongate flat horizontal cross beams disposed in the respective common elevations.

3. The combination of claim 1, wherein:

each elongate flat vertical post extends between a bottom end and top end, and each vertical post being formed with five apertures spaced vertically apart from one another, comprising:

a lowest aperture for receiving a fastener for making a connection with a relatively lower vertical post by way of a plural hole link, a three progressively succeeding apertures for receiving fasteners for making connection three horizontal cross beams and side beams at three staggered shelf elevations, and a lowest aperture for receiving a fastener for making a connection with a relatively lower vertical post by way of a plural hole link;

each elongate flat horizontal cross beam extends between opposite ends and is at least formed symmetrically with two apertures, each of which two apertures is proximate one or the other of the opposite end of the elongate flat horizontal cross beam;

each abbreviated side beam with bent ends is at least formed symmetrically with five apertures, one aperture each in each bent and which are diametrically opposite each other, three more apertures in the main elongate run, a first such aperture being in the center and a second and third such apertures being proximate margins proximate the bent ends; and each elongate side tie beam extends between opposite ends and is at least formed symmetrically with three apertures, a central aperture and also flanking apertures respectively proximate one or the other of the opposite ends of the elongate side tie beam.

4. The combination of claim 1, wherein:

the single size fastener comprises quarter inch carriage bolt and nut.

5. The combination of claim 1, wherein:

each plural hole flat link is a 3-hole flat link and is formed with a center hole and two flanking holes aligned on a common axis with the central hole and spaced a same distance apart from the central hole.

6. The combination of claim 1, wherein:

each plural hole flat link is a 2-hole flat link and is formed with holes.

7. The combination of claim 1, wherein:

the ends of vertical posts are connected by 2-hole links.

8. The combination of claim 7, further comprising:

a modular unit comprising four of the elongate flat vertical posts arranged in a 2×2 quadrilateral array and at least three pairs of the elongate flat horizontal cross beams;

each pair of elongate flat horizontal cross beams being fastened to the four elongate flat vertical posts in a common elevation as well as in a fore-to-aft spacing;

the at least three pairs of elongate flat horizontal cross beams being fastened to the four elongate flat vertical posts at least three vertically spaced elevations; and at least three shelf members, one each for resting across one of the at least three pairs of elongate flat horizontal cross beams disposed in the respective common elevation.

9. In combination with a supply of a single size fastener as well as with a supply of generally flat planar forms trimmed to generally rectangular shapes to serve as shelf panels, an expandable modular shelf assembly comprising:

a stock in various numbers of at least six flat metal bar stock components, consisting of:

elongate flat vertical posts, elongate flat horizontal cross beams, horizontal side beams, wherein each side beam has a main elongate run flanked between spaced bent ends contained in a common horizontal plane whereby the each side beam has a U-shaped in plan form, elongate flat side tie-beams arranged in X-shaped pairs, 2-aperture flat links for making various connections, and 3-aperture flat links for making various connections.

10. The in combination of claim 9, further comprising:

a modular unit comprising four of the elongate flat vertical posts arranged in a 2×2 quadrilateral array and at least three pairs of the elongate flat horizontal cross beams;

each pair of elongate flat horizontal cross beams being fastened to the four elongate flat vertical posts in a common elevation as well as in a fore-to-aft spacing;

the at least three pairs of elongate flat horizontal cross beams being fastened to the four elongate flat vertical posts at least three vertically spaced elevations; and at least three shelf members, one each for resting across one of the at least three pairs of elongate flat horizontal cross beams disposed in the respective common elevation.

11. In combination with a supply of a single size fastener as well as with a supply of generally flat planar forms trimmed to generally rectangular shapes to serve as shelf panels, an expandable modular shelf assembly comprising:

a stock in various numbers of at least seven flat metal bar stock components, consisting of:

elongate flat vertical posts, elongate flat horizontal cross beams, horizontal side beams, wherein each side beam has a main elongate run flanked between spaced bent ends contained in a common horizontal plane whereby the each side beam has a U-shaped in plan form, elongate flat side tie-beams arranged in X-shaped pairs, 2-aperture flat links for making various connections, 3-aperture flat links for making various connections, and elongate flat rear tie-beams arranged in X-shaped pairs.

* * * * *